US005343730A

United States Patent [19]

Steinhauser

[11] Patent Number: 5,343,730

[45] Date of Patent: Sep. 6, 1994

[54] TURNING DEVICE FOR AN AUTOMATIC CROSS-TRANSFER PRESS

[75] Inventor: Ulrich Steinhauser, Allschwil, Switzerland

[73] Assignee: Hatebur Umformmaschinen AG, Switzerland

[21] Appl. No.: 13,299

[22] Filed: Feb. 4, 1993

[30] Foreign Application Priority Data

Feb. 11, 1992 [EP] European Pat. Off. ..... 92810098.1

[51] Int. Cl.[5] ..... B21D 43/05

[52] U.S. Cl. ..... 72/405; 72/421; 470/154

[58] Field of Search ..... 72/405, 421; 470/95, 470/109, 154

[56] References Cited

U.S. PATENT DOCUMENTS 3,466,917 9/1969 Eakin et al. ..... 72/405
3,965,718 6/1976 Kline ..... 72/405
4,186,589 2/1980 Criblez ..... 72/421
4,351,180 9/1982 Alebach ..... 72/405
4,430,882 2/1984 Steinhauser ..... 72/405

FOREIGN PATENT DOCUMENTS 2114674 9/1970 Fed. Rep. of Germany .

*Primary Examiner*—David Jones
*Attorney, Agent, or Firm*—Ralph W. Selitto, Jr.

[57] ABSTRACT

The turning device has a guideway (13) which is formed integrally on the tong carrier (3) and in which is guided the roller (16) of an oscillating lever (15). The reciprocating movement of the guideway (13) is transmitted via the oscillating lever (15) to a pivot pin (14). The latter turns the portion (A) in conjunction with a counter-holder (22). The turning device is used on horizontal cross-transfer presses having a high production rate for metal forming starting from portions of wire.

16 Claims, 5 Drawing Sheets

Figure 1:
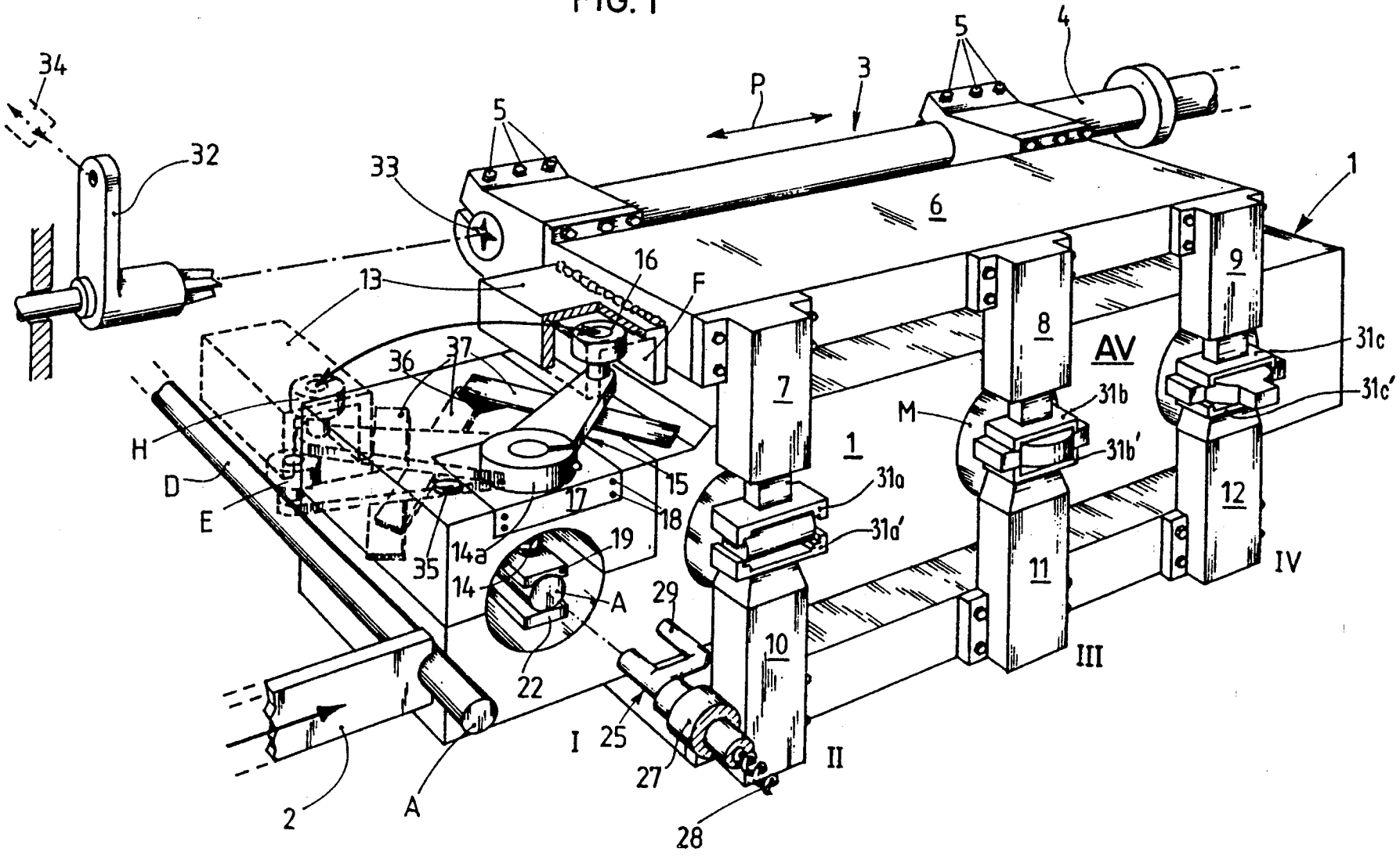

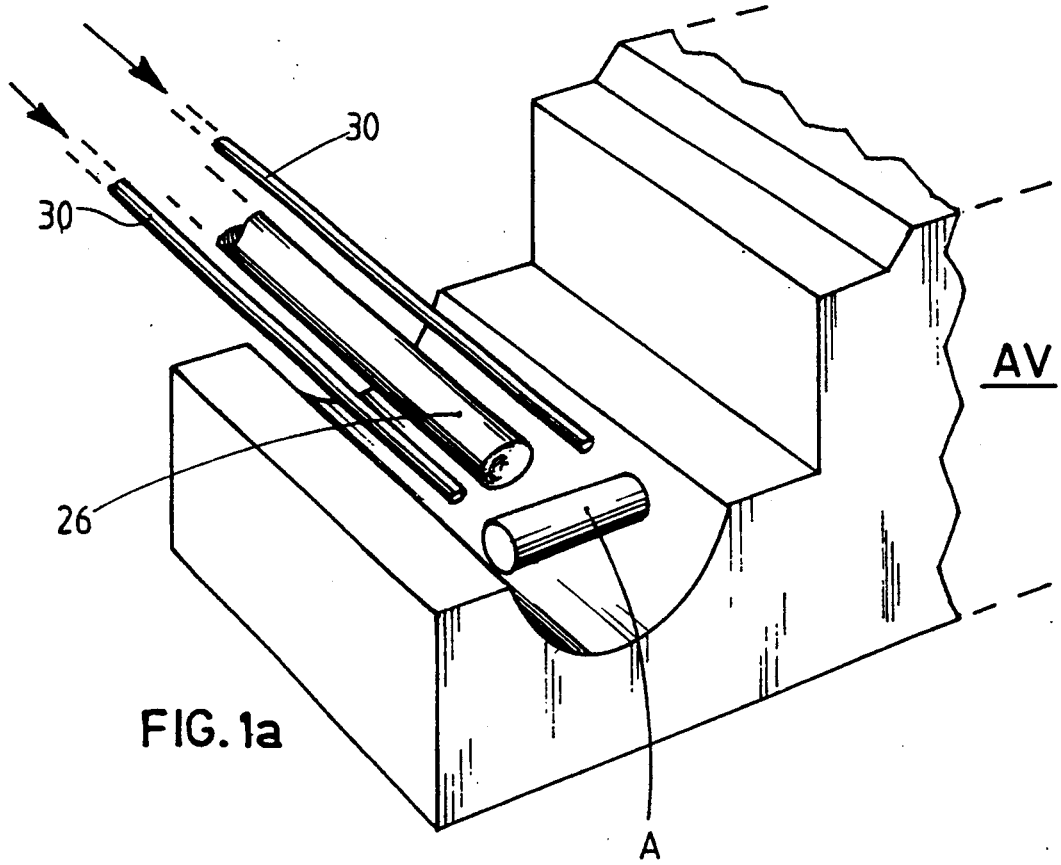
FIG. 1a
FIG. 1b
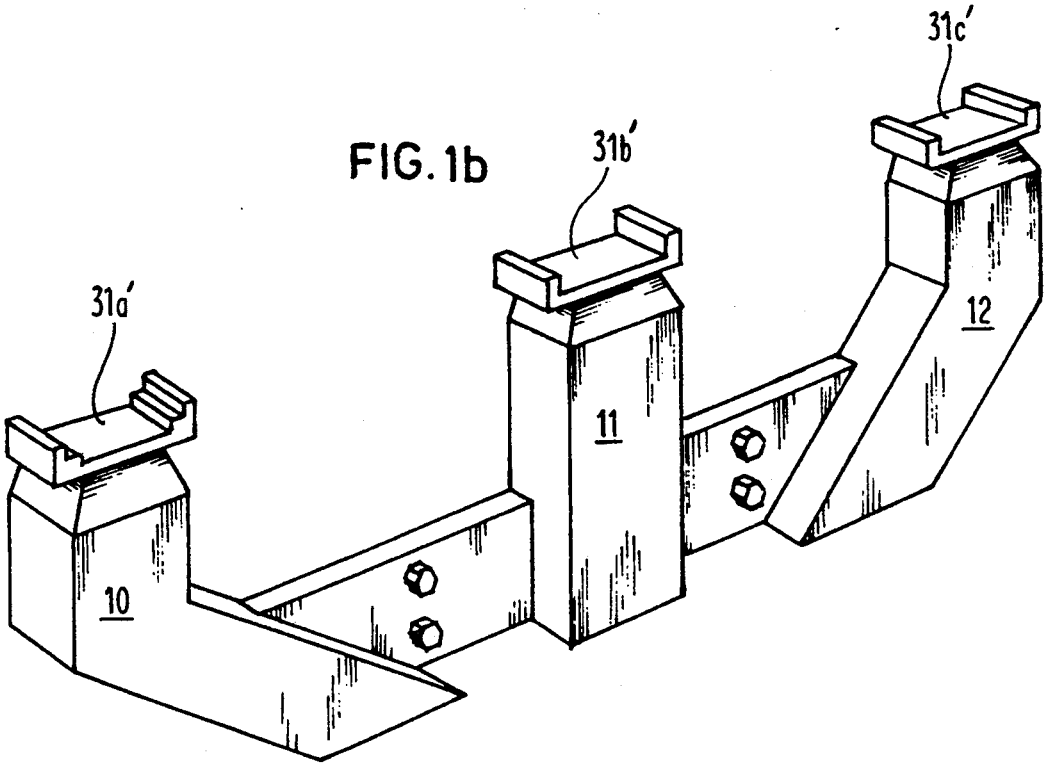

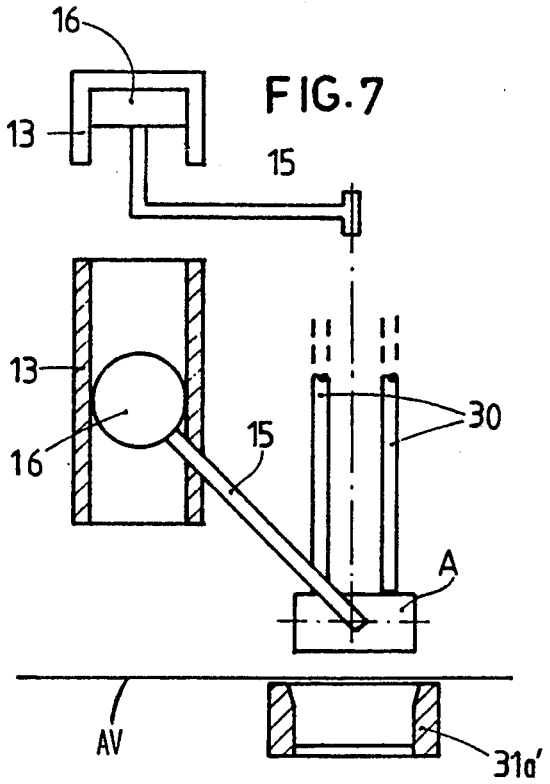
FIG. 7
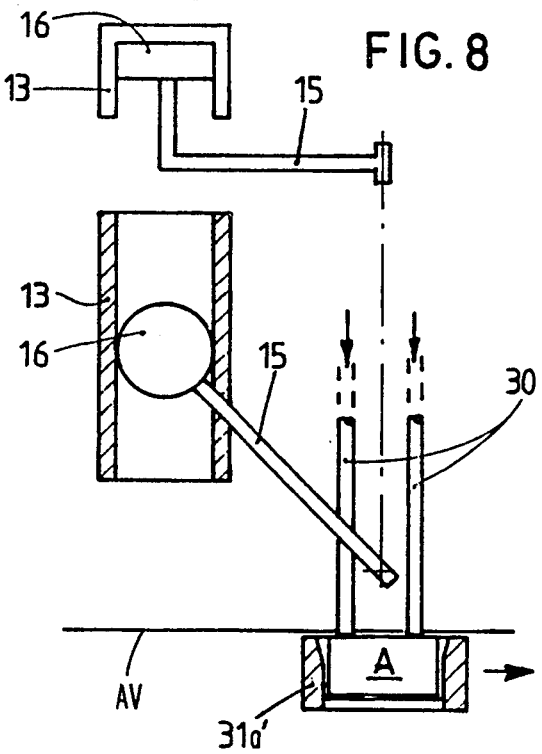
FIG. 8
FIG. 1c
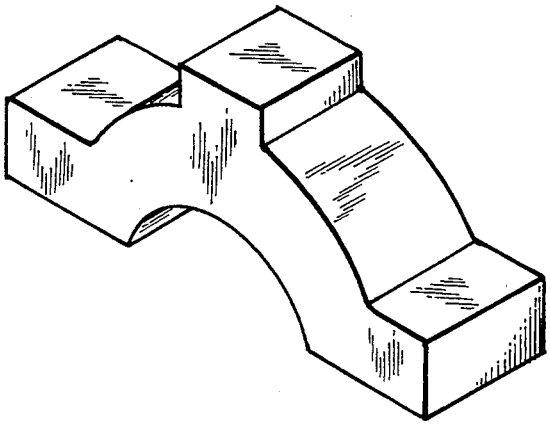

TURNING DEVICE FOR AN AUTOMATIC CROSS-TRANSFER PRESS

The invention relates to a turning device for an automatic cross-transfer press for processing cylindrical portions sheared off from a wire to give pressed parts.

In conventional multi-stage forming machines which form parts directly from wire coil or bars, the starting material is, next to the press slide in the axial direction of the press, pulled against a stop and sheared off with a shear. The shear slide here serves simultaneously as a means for feeding the sheared-off blank to a position in front of the first forming station or into a charging station, the longitudinal axis remaining parallel to the axis of the press.

If the aim is to form a pressed part, the transverse extent of which, particularly in one direction, is considerably larger than the longitudinal dimensions, it can be very difficult or even impossible, due to the large degree of deformation and hence high pressing forces, to produce parts of this kind on such multi-stage presses.

This problem can be solved by developing a device which makes it possible to turn the sheared-off blank by 90° so that its longest extent is transverse to the axis of the press; the blank thus lies crosswise in front of the die of a first forming station. It should be possible to fit this device to the original forming presses without too much outlay and as and when required.

The turning of the portion can be performed in a first work stage or during transfer from one stage to the other. In the first case, the first pair of tongs would take over an already turned portion and transfer it to a position in front of the first forming stage (second work stage).

An embodiment of the first type (turning in the first stage) is described in German Offenlegungsschrift 2,114,674.

According to this German Offenlegungsschrift 2,114,674, the portion is turned within the first work stage but is not introduced in a positively controlled manner. In addition, the geometry and surface condition of the portion have a very great influence on fault-free functioning under production conditions. This solution has therefore not stood the test of practical application.

European Patent 41, 690 shows a turning device which did not achieve wide acceptance due to the following disadvantages:

- complicated disassembly of the anvil during tool changing since fixed pivoting points are screwed to the anvil or anvil cover at the top and bottom.
- due to the underlying principle, the axis of rotation of the lower turning tong is arranged in front of the front edge of the anvil. It is, therefore, exposed to extreme contamination by the cooling water and this is highly conducive to wear.
- there is a risk of collision between the lower tong and, in particular, parts which are to be removed, and this must have a destructive effect on a rotatably controlled embodiment.

It is therefore the object of the present invention to propose a cross-transfer press, the turning station of which, in contrast to the known solution proposals

- does not require a lower rotatable tong element and is thus less fault-prone,

- carries out turning behind the front edge of the anvil, with the result that this operation cannot be interfered with by a portion which is dropped,
- permits problem-free tool changing since, when removing the anvil cover, the entire turning device can simultaneously be removed,
- permits problem-free removal of the anvil cover since there is no interfering turning-drive linkage, i.e. spatial mechanism comprising a crank with attached coupling link, to block access with the upper tong pivoted up and
- virtually eliminates any malfunctions due to dropped portions.

This object is achieved by the present invention, which is defined in the characterising part of independent Patent claim 1. Preferred embodiments are defined in the dependent patent claims.

Figure 2:
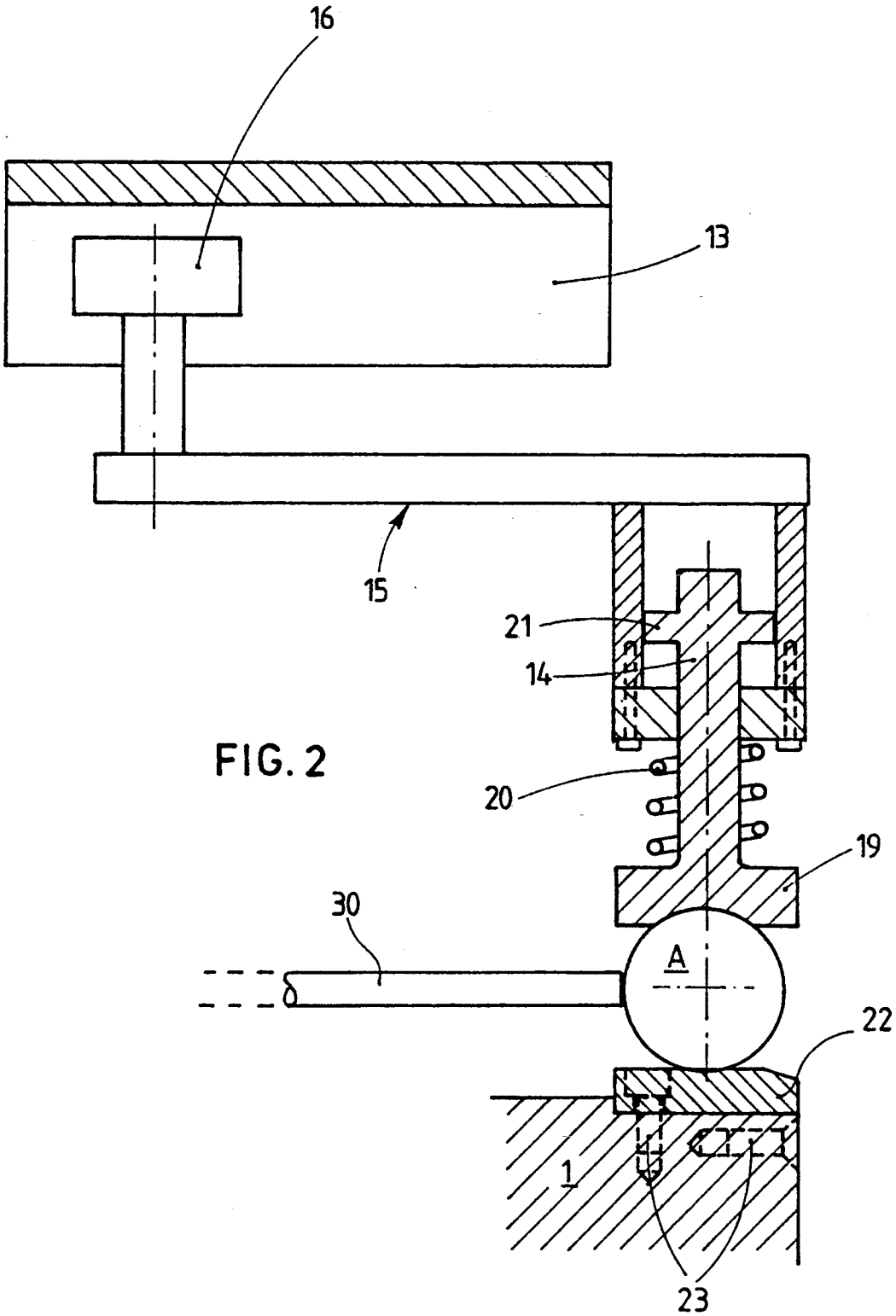

An illustrative embodiment of the subject-matter of the invention is explained below with reference to the attached drawing, in which:

FIG. 1 shows a simplified perspective view of three forming stations with a turning station and a transfer device, FIGS. 1*a*/1*b* show two embodiment details, FIG. 1*c* shows a typical half-finished product, FIG. 2 shows a sectional representation of the turning drive and FIGS. 3 to 8 show a schematic representation of the various turning phases.

FIG. 1 shows an anvil 1 which is arranged at a fixed location in the machine and in which are arranged four work stations I to IV. Work stations II to IV are purely forming stations, in which a portion of bar is pushed into a die by a punch and, in the process, formed. The punches are as usual arranged coaxially to the dies on a press slide driven in reciprocating fashion. The design of the formed parts to be produced is known to the person skilled in the art and is therefore not shown. A typical half-finished product, the transverse extent of which exceeds the longitudinal dimensions several times over is, for example, shown in FIG. 1*c*.

Work stage I is a turning station, at which the length A cut from the wire D by a shear 2 is turned through 90° in a horizontal plane before being formed.

A tong carrier 3 movable backwards and forwards in arrow direction P is connected to a drive (not shown) via two hollow shafts 4, of which only the upper shaft is visible and which are clamped onto the tong carrier 3 by means of bolts 5. The tong carrier 3 carries a tong carrier box 6, at the top and bottom of which, at the front, the tong brackets denoted by 7 to 12 are arranged in a fixed manner. Secured on the said tong brackets are the transfer tongs 31/*a*/31*a*, which thus move backwards and forwards periodically with the tong carrier and, in the process, move the portion A from one work station to the other.

The turning station I includes, inter alia, a downwardly open U section 13 which, in accordance with its function, is henceforth referred to as guideway 13, is secured on the tong carrier box 6 and therefore takes part in the reciprocating movement of the latter. The guideway 13 can be formed integrally on the tong carrier box 6 and form a single part with the latter. A pivot pin 14 is rotatably mounted in the section of the anvil 1 corresponding to the first work station I and is connected in torsionally rigid fashion to an oscillating lever 15 at its upper part 14*a* projecting out of the anvil 1, the free end of the said lever carrying a transmission roller 16 projecting into the guideway 13. A cover plate 17 secured on the anvil 1 by means of screws 18 guarantees that the pivot pin 14 is easy to remove.

The reciprocating movement of the tong carrier 3 is thus transmitted from the guideway 13, via the transmission roller 16 and the oscillating lever 15 to the pivot pin 14.

At the lower end of the pivot pin 14 there is a driver 19 which, according to FIG. 2, is pressed downwards by a compression spring 20, the travel path of the driver 19 being limited by a stop 21. The cylindrical portion A can thus be pushed between the spring-loaded driver 19 and a fixed counter-holder 22 which is secured on the anvil 1 by means of screws 23. Depending on what is required, the counter-holder 22 could also be rotatably mounted in order to facilitate the turning of the portion A. FIGS. 3 to 8 illustrate the movement of the oscillating lever 15 and the turning of the portion A. After the 90° turn has been performed (FIGS. 7 and 8), the portion is pushed into the waiting transfer tongs 31*a*/31*a'* by an ejector 30 and fed by these to the first forming station II. At the tops of the FIGS. 3 to 8 front views of the guideway 13, the transmission roller 16 and the oscillating lever 15 are shown in its actual potation. Below the front views the respectively horizontal sections are drawn in connection with a portion A.

Figure 3:
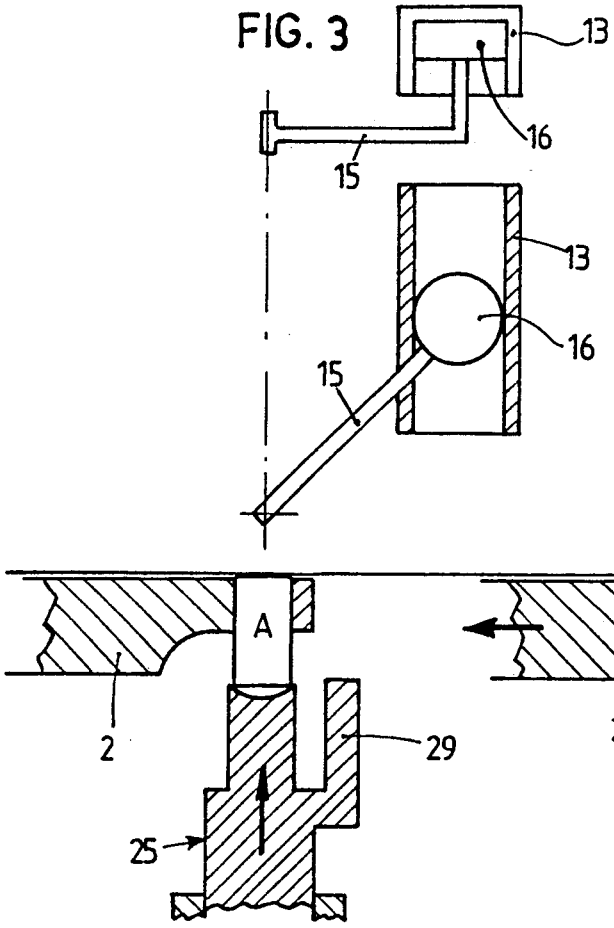
Figure 4:
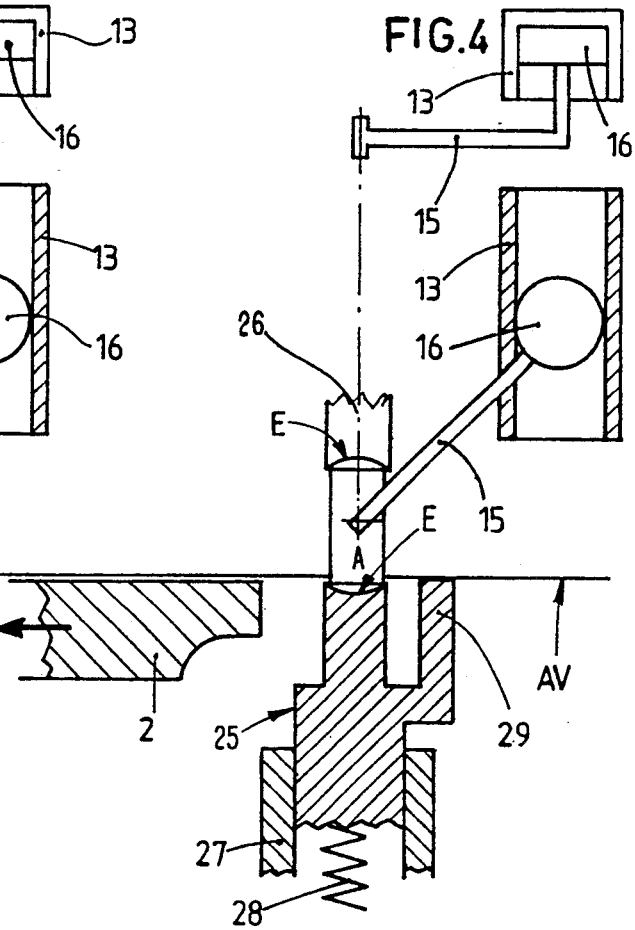
Figure 5:
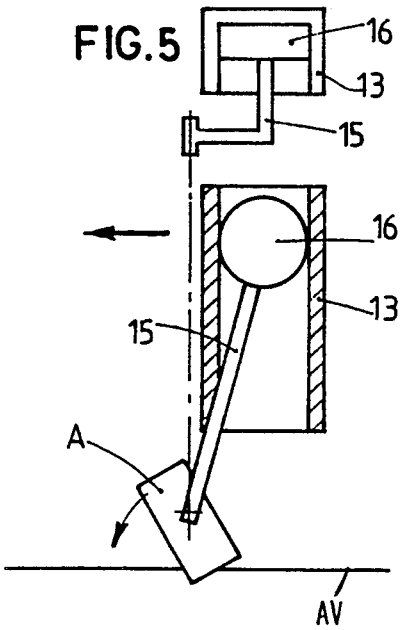
Figure 6:
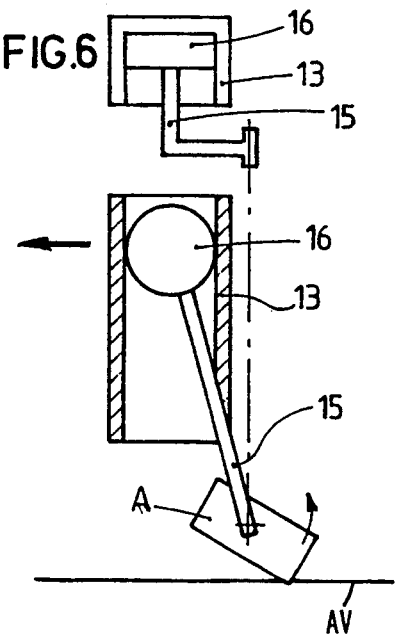

According to FIG. 3, which shows the oscillating lever 15 schematically in its starting position, the shear 2, supported by a slide has just pushed the cylindrical portion A of bar in front of a holding pin 25, the task of which is to push the portion A between the driver 19 and the counter-holder 22. As is furthermore shown by FIG. 4, after being pushed into its turning position the portion A is held at its ends by the holding pin 25 and a fixed, adjustable stop pin 26. In order to avoid hindering the rotation of the portion A, which amounts, for example, to 90° but, in practice, can vary by ±45°, the end faces of the holding pin 25 and the stop pin 26 are provided with a recess E, which preferably has the shape of a spherical cup. The holding pin 25, which is guided in a bush 27 and preloaded by a spring 28, is provided with a laterally projecting arm 29. The spring 28, which is designed as a helical spring, but can also be replaced by a pneumatic cylinder, pushes the portion into the turning stage, while the arm 29 limits the forward travel of the holding pin 25 upon striking against the front edge AV of the anvil.

The turning apparatus described can be fitted to existing machines without difficulty and also removed easily once the pivotably mounted tong carrier 6 has been pivoted up by means of the pivoting device indicated at 32 in FIG. 1. The pivoting device 32, which is known per se and the coupling spigot of which can be inserted into a hole 33 in the tong carrier box 6, is rotatably mounted and can be pivoted by means of a drive 34.

The length of the roller lever, which is matched to the cross-transfer travel, and the symmetric positioning of the end positions of the travel of the guideway in relation to the axis of the turning stage give precisely the required pivoting angle.

The tong carrier 3 and the shear slide 24 (FIG. 3), which moves the sheared-off portion in front of the turning stage I, move approximately in synchronism, with the result that the portion is in front of the turning stage I and is pushed into the latter by the spring-loaded holding pin 25 while the cross-transfer process remains in the end position of travel of the "move" phase. Even before the end of the "push-in" phase, the shear slide with the shear 2 can move back to the shearing stage.

Once the portion has been pushed in fully, the spring-loaded holding pin 25 is held at rest against the front edge AV of the anvil by its stop finger 29, the tong carrier 3 moves in idle return mode back into the end position for collecting, and the guideway 13 secured on the tong carrier 3 simultaneously pivots the oscillating lever 15, this time by precisely 90°, with the result that the portion A held fast in a sprung manner in the turning stage is turned horizontally by way of the positive engagement of the driver 19. After turning has been carried out, the gripper tongs Z are in front of the turning station I, with the result that the two cam-controlled ejectors 30 (FIG. 7) push the portion A, the longest extent of which is now transverse to the press axis, out of the driver 19 from behind into the gripper tong 31*a*/31*a'*, it being necessary for the driver 19 to be pushed upwards counter to the spring force.

By the cross-transfer process, the gripper tongs 31*a*/31*a* move the turned portion A into a position in front of the first forming stage; the turning apparatus is simultaneously turned back into the starting position, i.e. the portion push-in position, by the accompanying movement of the guideway 13.

The ejector pins 30 are released by the control cam (not shown) at the appropriate time and, if required, retracted or released to allow them to be pushed back.

The driver 19 in the turning stage I and the fixed counter-holder 22 situated opposite are wearing parts and are dimensioned in dependence on the diameter of the portion and can only be exchanged with the turning stage removed. This is accomplished as follows:

The upper drive of the cross-transfer tong carrier 3 is disengaged, allowing the tong carrier 3 to be moved beyond the end position of the "collect" phase (FIG. 1) and coupled to a pivot-up device (32, 34) shown only in part; during this process, the oscillating lever 15 has been turned beyond the 90° turn position by the guideway 13 and, as a result, a snap-action device 35 retains the oscillating lever 15 in this removal and installation position E. The tong carrier 3 can now be moved into its pivoted-up position and, in the process, the downwardly open guideway 13 rises at the same time and the anvil cover of the turning stage I with the upwardly projecting oscillating lever is freely accessible for removal. The anvil cover is lifted out by means of a lifting device, the hook of which engages in an opening 36 in the anvil cover. A cover strip 37 secured on the oscillating lever 15 lies directly over the opening 36 during the operation of the turning stage I, preventing access to the said opening for the said hook. In the removal and installation position of the oscillating lever 15, the hook-in opening 36 of the anvil cover is freed for the lifting device by the cover strip 37 having been pivoted away, with the result that, upon reinstallation of the complete turning station, the oscillating lever 15 is in the only permitted position for the lowering of the guideway 13 onto the roller 16.

In the case of forming processes which do not require a turning station, the first stage can be converted back to a normal forming stage and, in this case, the guideway then has no function.

As has already been mentioned, it is possible by virtue of the present invention to dispense with the fitting of a lower rotatable tong element. For this reason, the tong element can, for example, be designed in the manner shown in FIG. 1*b*, providing a significant saving and a reduction in malfunctions. Further significant advantages of the arrangement described are the simplicity of removal and access of the tong carrier and of the die carrier (anvil) and the shifting of the turning operation to behind the forming plane.

As a departure from the illustrative embodiment described, the guideway 13 designed as a U section can also be arranged on the oscillating lever 15 or the oscillating lever 15 itself can be designed as a guideway with a U-shaped cross-section, in which case the U-shaped cross-section is upwardly open and the transmission roller rotatably mounted on the tong carrier box 6 should project from above into the guideway in order to allow the tong carrier box 6 to be pivoted up without problems to carry out exchange and repair work in this embodiment too.

In most cases, it will probably be expedient to fit the turning apparatus described as the first work station, ahead of the first forming stage II. It would, however, also be possible to install a turning station between any two forming stations, in which case the guideway 13 could then be fitted at the bottom of the tong carrier box 6.

The expression "guideway" used in the present context is to be understood as including not only a closed way (U section) but also open ways, which can, for example, be designed as a flat "straightedge", the transmission roller resting against the straightedge by virtue of spring force.

I claim:

1. A turning device for an automatic cross-transfer press for processing metallic portions (A), sheared off from a wire, to give pressed parts, the extent of which transverse to the pressing direction is greater than their extent in the pressing direction, the cross-transfer press having a die carrier (anvil 1 ) with a plurality of fixed dies (M) arranged horizontally adjacent to one another along a front surface (AV) of said die carrier (anvil 1), a press slide driven backwards and forwards with punches arranged coaxially in front of the dies (M), and a transfer device having a reciprocating tong carrier (3) which grasps with at least one gripper pair (31*a*/31*a*') the portion (A) to be formed and moves it from one forming station (II–IV) to the other, to a position in front of the respective die (M), comprising a vertical pivot pin (14) which is rotatably mounted in the die carrier (1) behind the front surface (AV) thereof, and an upper end of which is connected in torsionally rigid fashion to an oscillating lever (15), a guideway (13) being arranged on the tong carrier (3), in which guideway a transmission member (16) arranged on the oscillating lever (15) is mounted such that the reciprocating movement of the tong carrier (3) is transmitted via the guideway (13) and the transmission member (16) to the pivot pin (14) and from the latter to the portion (A) to be turned 90°±45° in a horizontal plane.

2. Turning device according to claim 1, characterised in that the guideway (13) is a U section which is arranged, preferably releasably, on the tong carrier (3) of the transfer device, in view of any scale which may occur and of the removability of the tong carrier is downwardly open and between the two parallel guide walls (F) of which the loose roller (16) of the oscillating lever (15) is guided.

3. Turning device according to claim 1, characterised in that the oscillating lever (15) carries a guideway of U-shaped cross-section or is itself designed as a U-shaped guideway, and in that a roller (16) arranged loosely on the tong carrier (3) projects into said guideway.

4. Turning device according to claim 1, characterised in that, at its lower end, the said pivot pin (14) has a driver (19) which is pressed downwards by a spring (20) arranged within the pivot pin (14) against the portion (A) to be held, which, for its part, rests on a fixed counter-holder (22) (FIG. 2).

5. Turning device according to claim 1, the turning station (I) being arranged as the first work stage ahead of the first forming station (II), characterised in that, after being sheared off, the cylindrical portion (A) is held at the ends in the turning station, between a sprung holding pin (25) and a stop pin (26) arranged at a fixed location on the die body, the end faces of the holding and stop pins which face the portion (A) each having a recess (E) corresponding to the turning radius of the edges of the portion.

6. Turning device according to claim 5, characterised in that the said recess has the shape of a spherical cup.

7. Turning device according to claim 5, characterised in that the sprung holding pin (25) has a stop finger (29) which projects laterally beyond its front edge and limits the travel of the holding pin (25) towards the portion (A) to be turned upon striking against the front edge (AV) of the anvil.

8. Turning device according to claim 1, characterised in that secured on the oscillating lever (15) is a cover strip (37) which, in the operating position of the turning device, covers an opening (36) provided for the removal of the said turning device, for the hooking of a lifting device, but, in an end position (E) provided for the removal of the said turning device frees the said opening.

9. A turning device for an automatic cross-transfer press for processing metallic portions (A), sheared off from a wire, to give pressed parts, the extent of which transverse to the pressing direction is greater than their extent in the pressing direction, the cross-transfer press having a die carrier (anvil 1 ) with a plurality of fixed dies arranged horizontally adjacent to one another along a front surface (AV) of said die carrier (anvil 1), a press slide driven backwards and forwards with punches arranged coaxially in front of the dies (M), and a transfer device having a reciprocating tong carrier (3) which grasps with at least one gripper pair (31*a*/31*a*') the portion (A) to be formed and moves it from one forming station (II–IV) to the other, to a position in front of the respective die (M), comprising a vertical pivot pin (14) which is rotatably mounted in the die carrier (1) behind the front surface (AV) thereof, and an upper end of which is connected in torsionally rigid fashion to an oscillating lever (15), a guideway (13) attached to the oscillating lever (15), in which guideway a transmission member (16) attached to the tong carrier (3) is received such that the reciprocating movement of the tong carrier (3) is transmitted via the guideway (13) and the transmission member (16) to the pivot pin (14) and from the latter to the portion (A) to be turned 90°±45° in a horizontal plane.

10. The turning device of claim 3, wherein said pivot pin (14) has attached at a lower end thereof a driver (19) pressed downwards by a spring (20) to grip said blank against a fixed counter-holder (22).

11. The turning device of claim 10, wherein said cross-transfer press includes a plurality of work stations and said turning device is located at a first work station at which said blank is oriented after shearing from said wire and prior to passage on to a metal working station, said turning device further including means for inserting said blank between said driver (19) and said counterholder (22) after said blank is sheared from said wire and means for limiting insertion depth of said blank.

12. The turning device of claim 11, wherein said means for inserting includes a spring suspended pin moving between a retracted position and an extended position and said means for limiting insertion depth includes a fixed mating stop pin juxtaposed relative said spring suspended pin such that a blank sheared from said wire may be gripped between said stop pin and said spring suspended pin when in the extended position.

13. The turning device of claim 12, wherein said spring suspended pin and said stop pin each have a recess in a face thereof for receiving said blank to facilitate gripping said blank therebetween.

14. The turning device of claim 13, further including means for limiting the motion of said spring suspended pin in the direction of extension.

15. The turning device of claim 14, further including means for enabling and disabling removal of said turning device from said press depending upon the position of said tong carrier.

16. A positioning device for orienting metal blanks sheared from wire stock to be worked in an automatic cross-transfer press having an anvil with a plurality of fixed dies arranged horizontally adjacent to one another along a front surface thereof, a press slide driven back and forth, punches arranged coaxially in front of said dies and a transfer device which grasps a blank to be worked and sequentially moves it into position in front of successive dies, comprising:

(a) a rotatable pivot pin extending through said anvil into a niche in said anvil, said niche opening on said front surface for receiving said blank therein, with the rotational axis of said pivot pin being substantially parallel to said front surface;

(b) means attached to said pivot pin at a first end located within said niche for gripping said blank;

(c) means for translating the back and forth motion of said tong carrier into a twisting motion of said pivot pin, said means for translating acting on said pivot pin at a second end thereof outside said niche and said anvil;

(d) means for loading said blank at a first angular orientation into said means for gripping, said first angular orientation being approximately the same as that assumed by said blank when first sheared from said wire stock; and (e) means for discharging said blank from said gripping means, said means for translating twisting said pivot pin, said gripping means and said blank into a second orientation when said tong carrier is moved to position said transfer device to receive said blank from said gripping means, said discharge means displacing said blank from said gripping means into said transfer device which receives said blank at said second orientation.

* * * * *